United States Patent [19]

Beaton et al.

[11] 4,004,921

[45] Jan. 25, 1977

[54] TREATMENT OF LEAD SULPHIDE

[75] Inventors: Stephen Peter Beaton, Amherstview; David Alan Harbourne, Kingston, both of Canada

[73] Assignee: Du Pont of Canada Limited, Montreal, Canada

[22] Filed: May 20, 1975

[21] Appl. No.: 579,361

[30] Foreign Application Priority Data

May 23, 1974 Canada ..... 200712

[52] U.S. Cl. ..... 75/77; 423/95; 423/512 R; 423/559

[51] Int. Cl.[2] ..... C22B 13/00

[58] Field of Search ..... 75/77, 86, 115, 120; 423/95, 512, 559

[56] References Cited

UNITED STATES PATENTS

| | | | |
|---|---|---|---|
| 1,062,120 | 5/1913 | McMahon et al. | 423/512 |
| 1,262,295 | 4/1918 | Young | 423/512 |
| 3,281,237 | 10/1966 | Meissner et al. | 75/77 |

FOREIGN PATENTS OR APPLICATIONS

| | | | |
|---|---|---|---|
| 154,902 | 8/1950 | Australia | 75/77 |

*Primary Examiner*—M. J. Andrews

[57] ABSTRACT

A process for the treatment of lead sulphide with an aqueous solution of sulphur dioxide at a temperature of at least 20° C and in the absence of oxygen is disclosed. In a preferred embodiment the lead sulphate and/or lead sulphite so formed is heated with lead sulphide at a temperature of 700° to 1200° C in the absence of oxygen. Metallic lead is obtained. In the preferred embodiment the lead sulphide may contain zinc sulphide whereby both metallic lead and metallic zinc may be obtained.

18 Claims, No Drawings

TREATMENT OF LEAD SULPHIDE

BACKGROUND

The present invention relates to a process for the treatment of lead sulphide with an aqueous solution of sulphur dioxide. In a particular embodiment the present invention relates to a process for the recovery of lead from lead sulphide.

Techniques for the treatment of lead sulphide are known. For example, lead sulphide may be treated by a pyrometallurgical process involving sintering the lead sulphide to remove sulphur as sulphur dioxide. Elemental lead is then produced by reduction of the sintered material, and the lead so obtained may be processed further by known methods. However, sulphur dioxide is produced in the sintering process and this gas may be the source of a potential pollution problem. The sulphur dioxide may be used in another process or converted to sulphur by treating the sulphur dioxide with hydrogen sulphide, to sulphuric acid for subsequent sale or disposal, or the sulphur dioxide may be sold as such. The way in which the sulphur dioxide is utilized may be an important factor in the economics of processes for the recovery of lead from lead sulphide. Lead sulphide may also be treated with sulphuric acid in the presence of oxygen at pressures above atmospheric pressure to produce lead sulphate. Lead may then be obtained by treating the lead sulphate in a pyrometallurgical process.

The known techniques for the treatment of lead sulphide and lead sulphate are capable of improvement especially with regard to the potential pollution problems associated with such techniques. Also, techniques are known for the reaction of iron sulphides with sulphur dioxide to obtain sulphur as in Canadian Patent No. 926,087 - Kunda, issued May 15, 1973, but such techniques do not utilize lead sulphides.

SUMMARY

It has now been found that lead sulphide may be treated with an aqueous solution of sulphur dioxide to form, depending on the process conditions, lead sulphate and/or lead sulphite. It has also been found that the latter compounds may be reacted with lead sulphide to give lead and sulphur dioxide, thereby allowing sulphur dioxide to be recycled in a process for the conversion of lead sulphide into lead and sulphur via the intermediates lead sulphate and/or lead sulphite.

Accordingly, the present invention provides a process for the treatment of lead sulphide to produce at least one of lead sulphite and lead sulphate comprising the step of contacting lead sulphide with an aqueous solution of sulphur dioxide at a temperature of at least 20° C substantially in the absence of oxygen. In some cases it will be preferred to produce lead sulphate, in other cases lead sulphite, and often it will be preferred to produce a mixture of lead sulphite and lead sulphate.

In one embodiment of the process of the present invention sulphur is separated from the lead sulphite so treated.

In another embodiment the treatment is carried out at a temperature of greater than 90° C, especially 90°–120° C.

In yet another embodiment the treatment is carried out at a temperature in the range 20°–90° C.

In a further embodiment approximately 50% of the lead sulphide treated is converted to at least one of lead sulphite and lead sulphate. Percentages and proportions herein are by weight except where indicated otherwise.

The present invention also provides a process for the recovery of lead from lead sulphide comprising the steps of (a) contacting lead sulphide with an aqueous solution of sulphur dioxide at a temperature of at least 20° C substantially in the absence of oxygen, (b) separating lead sulphate and/or lead sulphite in the resulting mixture from sulphur therein and (c) heating a mixture of lead sulphide and said lead sulphate and/or lead sulphite to a temperature in the range 700° to 1200° C substantially in the absence of oxygen, the sulphur dioxide formed on heating the mixture being removed therefrom.

In an embodiment of the process of the invention the treatment in step (a) is carried out at a temperature of at least 90° C, especially 90°–120° C.

In another embodiment the treatment in step (a) is carried out at a temperature in the range 20°–90° C.

In a further embodiment the temperature in step (c) is in the range 750°–900° C.

In a still further embodiment the mixture of lead sulphide, lead sulphate and lead sulphite comprises about one mole of lead sulphide per mole of lead sulphate and per two moles of lead sulphite.

In yet another embodiment only part of the lead sulphide contacted with an aqueous solution of sulphur dioxide in step (a) is allowed to react, and the remaining lead sulphide processed is used in step (c).

Furthermore the present invention provides a process for the recovery of lead from lead sulphide comprising the step of heating a mixture of lead sulphide and a compound selected from the group consisting of lead sulphate and lead sulphite, and mixtures thereof, to a temperature in the range 700°–1200° C substantially in the absence of oxygen, the sulphur dioxide formed on heating the mixture being removed therefrom.

Moreover the present invention also provides in a process for the recovery of lead and zinc from lead sulphide and zinc sulphide respectively, the step comprising heating a mixture of lead sulphide and zinc sulphide with a compound selected from the group consisting of lead sulphate and lead sulphite, and mixtures thereof, to a temperature in the range 700°–1200° C substantially in the absence of oxygen, the sulphur dioxide formed on heating the mixture being removed therefrom.

In a preferred embodiment the amount of the compound is approximately the stoichiometric amount for reaction with said lead sulphide and zinc sulphide.

DETAILED DESCRIPTION OF THE INVENTION

As disclosed hereinabove, the present invention relates to the treatment of lead sulphide with an aqueous solution of sulphur dioxide. The process may be carried out at temperatures of at least 20° C. At relatively low temperatures, for example 20°–90° C, the lead sulphide would appear to be mainly converted into lead sulphite. At higher temperatures, for example, up to 120° C, the initial product is believed to be lead sulphite but as exemplified hereinafter the final product of the process is lead sulphate. Sulphur and related products are formed as byproducts during the treatment process, the related products being sulphur byproducts, thus causing a consumption of sulphur dioxide that is greater than that predicted stoichiometrically. The process is carried out substantially in the absence of oxygen as the presence of oxygen may cause the formation of undesirable oxidation products. For example, the process may be carried out under a blanket of commercial-grade nitrogen substantially free of oxygen.

The process of the present invention may be carried out on high quality lead sulphide or on lead sulphide concentrates. Such concentrates, while having a large proportion of lead sulphide, may contain impurities that react with sulphur dioxide under the conditions of treatment described herein or, alternatively, that may be relatively inert to sulphur dioxide but which may react in subsequent steps in the process, for example, when lead sulphide is heated with lead sulphate and/or lead sulphite. Known impurities that react with an aqueous solution of sulphur dioxide include pyrrohotite ($Fe_{1-x}S$) which may be converted to water-soluble iron compounds. It is well known that $x$ in this formula can vary from zero to less than 0.5 as the sulphur content increases and the composition of $FeS_2$ (pyrite) is approached. These latter compounds are thus separable from the desired reaction products, lead sulphate and/or sulphite, or from the starting material lead sulphide. Other impurities, for example, $FeS_2$, FeAsS (arsenopyrite) or $CuFeS_2$ (chalcopyrite) may only react when heated with lead sulphite and/or lead sulphate. In such cases, it may be beneficial to treat the lead sulphide to reduce the concentration of such impurities in the concentrate.

As shown in the examples hereinafter zinc sulphide, which is frequently found in lead sulphide concentrates, reacts with an aqueous solution of sulphur dioxide at a substantially slower rate than lead sulphide. Zinc sulphide may, however, be heated with lead sulphate and/or lead sulphite to produce elemental lead, in the manner described herein for the related reaction of lead sulphide, and zinc oxide. The zinc oxide may be separated from the elemental lead using, for example, dilute sulphuric acid. The zinc may be separated from resultant solution by, for example, electrowinning. Thus mixtures of lead sulphide and zinc sulphide may be a source of both elemental lead and elemental zinc.

The aqueous solution of sulphur dioxide is preferably a saturated solution of sulphur dioxide in water under the conditions of the process of the present invention. Furthermore, it is preferable to operate the process of the present invention under pressure to increase the concentration of sulphur dioxide in the water. The pressure may be primarily determined by the temperature used and by the vapour pressure of the aqueous solution of sulphur dioxide at such temperatures. Water is believed to be an important factor in the treatment of lead sulphide with sulphur dioxide in accordance with the invention.

The mixture of lead sulphate and/or lead sulphite, sulphur and related products and unreacted lead sulphide, if any, obtained on treatment of lead sulphide with the aqueous solution of sulphur dioxide may be used without further treatment if desired. It is, however, preferable to treat the mixture for removal of sulphur and related products. This may be accomplished by, for example, extraction techniques using nitrogen or steam at elevated temperatures, perchloroethylene or carbon disulphide. Oxidation techniques may also be used but the sulphur dioxide formed is a potential pollution problem. Such sulphur dioxide may, however, be recycled for use in the treatment of lead sulphide, used in another process or sold as such.

Elemental lead may be obtained from the mixture of lead sulphate and/or lead sulphite and unreacted lead sulphide, if any. For example, lead sulphide may be added to the mixture, if necessary, to preferably obtain an approximately stoichiometric mixture of lead sulphate and/or lead sulphite with lead sulphide, i.e., preferably one mole of lead sulphide per mole of lead sulphate or per two moles of lead sulphite. While it is not essential to use an approximately stoichiometric mixture it is preferable to do so as such a mixture is potentially the most economic mixture. However, under some cicumstances it may be desirable to use a small excess of one or more of the reactants, especially of lead sulphide.

To obtain elemental lead the mixture of lead sulphide, lead sulphate and lead sulphite is heated to a temperature in the range 700°–1200° C, preferably in the range 750°–900° C. Sulphur dioxide is also formed under these conditions. It is believed to be important to remove the sulphur dioxide from the mixture as it is formed. This may be accomplished by, for example, passing an inert gas, e.g., nitrogen, over the mixture or by heating the mixture under pressures significantly lower than atmospheric pressure. The sulphur dioxide may be used in another process or preferably in the treatment of lead sulphide with an aqueous solution of sulphur dioxide, as described hereinabove. The elemental lead may be recovered, and purified, by known techniques. The present invention thus provides a process for the conversion of lead sulphide into lead and sulphur, sulphur dioxide being recycled in the process.

In a preferred embodiment the treatment of the lead sulphide with the aqueous solution of sulphur dioxide is carried out so that an approximately stoichiometric mixture of lead sulphide and of lead sulphate/lead sulphite is produced. This mixture may then be heated without further addition of lead sulphide. In practice it may be preferable to produce a mixture slightly deficient in lead sulphide and to add the required amount of lead sulphide to obtain a mixture of the desired composition.

While the step of heating lead sulphide with lead sulphate and/or lead sulphite has been described hereinabove with reference to lead sulphate and/or lead sulphite obtained by the treatment of lead sulphide with an aqueous solution of sulphur dioxide, the step may also be carried out using lead sulphate and/or lead sulphite obtained from another source.

The invention is illustrated by the following examples:

EXAMPLE I

Lead sulphide was contacted with an aqueous solution of sulphur dioxide in a sealed glass tube from which air had been excluded. The resultant mixture was heated at 100° C for a period of time. Unreacted sulphur dioxide was then recovered from the mixture. After filtering the mixture, sulphur was removed from the residue by soxhlet extraction techniques using carbon disulphide as solvent and the remaining solid residue was analyzed using X-ray powder diffractometry.

All chemicals used in the above example, and in the examples that follow, were laboratory chemicals, unless specified to the contrary. The lead sulphide was a sample of galena which showed no measurable impurities when analyzed by X-ray diffraction analysis.

The results are given in Table I. The analytical results given therein and in the examples hereinafter are all believed to be accurate to better than ±5%.

TABLE I

| Run | 1 | 2 |
|---|---|---|
| Reaction Time (hours) | 24 | 48 |
| Ingredients | | |
| Lead Sulphide* (gm) | 2.43 | 6.70 |
| Sulphur Dioxide (gm) | 3.26 | 3.26 |
| Water** (ml) | 10 | 10 |
| Products | | |
| Unreacted Sulphur Dioxide (gm) | 1.63 | ca 0.0 |
| Sulphur (gm) | 0.61 | 1.15 |
| Lead Sulphate (gm) | 2.60 | 6.58 |
| Unreacted Lead Sulphide (gm) | 0.88 | 1.10 |

*ground to −230 mesh ("Tyler" sieve number)
**contained one drop of isopropyl alcohol

EXAMPLE II

Using the procedure of Example I, 2.5 gm of lead sulphide, 3.26 gm of sulphur dioxide and 10 ml of water (containing one drop of isopropyl alcohol) were placed in each of five tubes. The tubes were sealed, air being excluded from the tubes, and heated to 107° C for various periods of time. Subsequently, the heat mixtures were analyzed for lead sulphite using the procedure of Example I.

The results are given in Table II.

TABLE II

| Reaction Time (hours) | 1* | 6 | 12 | 24 | 48 |
|---|---|---|---|---|---|
| Lead Sulphide Reacted (%) | 30 | 80 | 85 | 90 | 93 |

*Lead sulphide converted mainly to lead sulphite in one hour sample but to lead sulphate with no detectable amounts of lead sulphide at remaining times.

EXAMPLE III

To show the effect of reaction temperature the procedure of Example II was repeated. The reaction mixtures were heated at temperatures between 25° C and 107° C for various intervals of time. The results are given in Table III.

TABLE III

| Run | 3 | 4 | 5 | 6 |
|---|---|---|---|---|
| Reaction Temperature (° C) | 25 | 57 | 77 | 107 |
| Reaction Time (hours) | 48 | 6 | 6 | 6 |
| Lead Sulphide Reacted (%) | 20 | 35 | 45 | 80 |
| Main Reaction Product | $PbSO_3$ | $PbSO_3$ | $PbSO_3$ | $PbSO_4$* |

*See Table II, initial reaction product is $PbSO_3$.

EXAMPLE IV

To demonstrate the reaction between lead sulphide and lead sulphate, lead sulphide (8.91 millimoles) and lead sulphate (8.94 millimoles) were mixed and heated to about 800° C while passing a slow stream of nitrogen. A reaction began at 700°–750° C. At 800° C the mixture reacted rapidly to give lead (17.7 millimoles) and sulphur dioxide (20.7 millimoles). Lead sulphite was detected in a sample of partially reacted mixture.

EXAMPLE V

To demonstrate the reaction between lead sulphide and lead sulphite, lead sulphide (5.0 millimoles) and lead sulphite (10.0 millimoles) were mixed and, while passing a slow stream of nitrogen, heated to about 800° C for about two hours. The mixture reacted to give lead (17 millimoles) and sulphur dioxide (14.9 millimoles).

EXAMPLE VI

Three samples of lead sulphide were contacted with an aqueous solution of sulphur dioxide in sealed glass tubes from which air had been excluded. The resultant mixtures were heated at 107° C for seven hours. Unreacted sulphur dioxide was then recovered from each mixture. After filtering each of the mixtures, sulphur was removed by soxhlet extraction techniques using carbon disulphide as a solvent. The remaining solid residue was analyzed using X-ray powder diffractometry to obtain the ratio of lead sulphate to lead sulphide.

A measure of the ratio of lead sulphate to lead sulphide in the solid residue was also obtained by treating the solid residue with a slightly acidified saturated sodium chloride solution at 60°–65° C. The mixture was filtered and the filtrate, after being treated with hydrogen peroxide, was analyzed for the soluble sulphates by X-ray fluorescence and/or atomic absorption.

The results are given in Table IV.

TABLE IV

| Run | 7 | 8 | 9 |
|---|---|---|---|
| Ingredients | | | |
| Lead Sulphide[a] (initial) (gm) | 2.64 | 2.58 | 2.36 |
| Sulphur Dioxide (initial) (gm) | 3.26 | 3.26 | 3.26 |
| Water[b] (ml) | 10 | 10 | 10 |
| Products | | | |
| Unreacted Sulphur Dioxide (gm) | 2.10 | 1.81 | 2.05 |
| Elemental Sulphur (gm) | 0.63 | 0.53 | 0.54 |
| Lead Sulphate[c] (gm) | 2.54 | 2.60 | 2.39 |
| Unreacted Lead Sulphide (gm) | 0.42 | 0.46 | 0.42 |
| Soluble Sulphur (as Sulphate, gm)[d] | ca 0.0 | 0.48 | 0.41 |

[a]Ground to less than 230 mesh ("Tyler" sieve number)
[b]Contained one drop of isopropyl alcohol in Run 7
[c]Run 7 ... based on ca 6:1 weight ratio of $PbSO_4$:PbS determined by X-ray analysis. Runs 8 and 9 ... based on 85:15 weight ratio of $PbSO_4$:PbS. X-ray analysis indicated ca 5:1 weight ratio while sodium chloride extraction indicated 88:12 weight ratio.
[d]Soluble sulphur in the filtrate was analyzed by X-ray fluorescence and/or atomic absorption after treatment of the filtrate with hydrogen peroxide to convert sulphides, sulphates, sulphites and polysulphides to the sulphates.

EXAMPLE VII

Lead sulphide (9.99 millimoles) and a mixture of lead sulphate (4.95 millimoles) and lead sulphite (9.99 millimoles) were mixed and, while passing a slow stream of nitrogen, heated to about 800° C. for 2 hours. The mixture reacted to give elemental lead (25.1 millimoles) and sulphur dioxide (24.0 millimoles).

EXAMPLE VIII

Using a procedure similar to that described in Example I, zinc sulphide was treated with an aqueous solution of sulphur dioxide at 100° C. The zinc sulphide reacted slowly. Only 10–20% of the zinc was dissolved in 48 hours.

Zinc sulphide (9.1 millimoles) was mixed with lead sulphate (13.8 millimoles) and, while passing a slow stream of nitrogen, heated to 800° C for 2 hours. The mixture reacted to give zinc oxide (8.6 millimoles), elemental lead (13.8 millimoles) and sulphur dioxide (22.7 millimoles), analysis being made by X-ray diffraction. The zinc oxide was separable from the lead using dilute sulphuric acid.

EXAMPLE IX

Samples of two lead sulphide concentrates were contacted with aqueous solutions of sulphur dioxide in sealed tubes from which air had been excluded. The resultant mixtures were heated at 100° C for a period of time. Unreacted sulphur dioxide was then recovered from the mixture. The mixture was filtered and elemental sulphur was recovered from the residue using carbon disulphide extraction techniques. Lead sulphate and lead sulphite in the reaction products were removed using acidified saturated sodium chloride solutions at 50° C.

A sample of lead sulphide was treated using the same procedure.

Further experimental details and the results obtained are given in Table V.

TABLE V

| Run | 10 | 11 | 12 |
|---|---|---|---|
| Sample[a] | Concentrate No. 1 | Concentrate No. 2 | Lead Sulphide |
| Reaction Time (hours) | 6.5 | 2 | 2 |
| Ingredients | | | |
| Sample weight[b] (gm) | 4.12 | 6.15 | 5.96 |
| Sulphur Dioxide (initial) (gm) | 4.94 | 3.26 | 3.26 |
| Water (ml) | 10 | 10 | 10 |
| Products | | | |
| Unreacted Sulphur Dioxide (gm) | 3.83 | 1.81 | 1.51 |
| Elemental Sulphur (gm) | 0.24 | 0.51 | 0.42 |
| Lead Sulphate/Sulphite[c] (gm) | 0.5 | 2.84 | 3.30 |
| Unreacted Lead Sulphide (gm) | 0.0 | 2.80 | 3.18 |

[a]Concentrate No. 1 was a sulphide concentrate containing 13.2% Pb, 4.32% Cu, 6.85% Zn, 31.8% Fe, 38.4% S, 2.25% Si and 132.7 oz/ton Ag.

Concentrate No. 2 was a sulphide concentrate containing 75.8% Pb, 2.9% Zn, 2.6% Fe with the total of the sulphides being 97.46%.

The lead sulphide was the same as used in Example I.

[b]Based on analyses the weights of lead sulphide were 0.64 gm in Run 10 and 5.38 gm in Run 11.

[c]X-ray diffraction analyses showed only $PbSO_4$ in the lead sulphate/sulphite of Run 10 and mixtures of $PbSO_4$ and $PbSO_3$ in Runs 11 and 12.

EXAMPLE X

To demonstrate the reaction between lead sulphide and lead sulphate under reduced pressure, 1.20 gm of a sulphide concentrate containing 4.41 mmoles of lead sulphide and 0.53 mmoles of zinc sulphide were mixed with 5.30 mmoles of lead sulphate and heated to about 800° C in a sealed tube that had been evacuated to a high vaccum to exclude essentially all oxygen. The sealed tube was connected to a cold trap (−196° C) to collect the sulphur dioxide evolved. After heating for 2 hours 10.0 mmoles of sulphur dioxide had been collected. Analysis of the heated mixture by X-ray diffraction indicated the presence of metallic lead.

EXAMPLE XI

The lead sulphide concentrate identified as Concentrate No. 2 in Example IX was treated with an aqueous solution of sulphur dioxide under conditions similar to those of Example I. The reaction product so obtained contained lead sulphide, lead sulphate and sulphur.

1.84 gm of a sample of the above reaction product was heated. At the same time a mixture of steam and nitrogen was passed, at atmospheric pressure, over the sample. When the temperature of the sample was about 200° C removal of sulphur from the sample by the mixture of steam and nitrogen was observed; the rate of removal appeared to increase as the temperature of the sample increased to about 300° C. The temperature of the sample was maintained at 300° C for about 15 minutes; the total heating time being about 25 minutes. X-ray diffraction analysis of the sample so treated indicated the presence of lead sulphide and lead sulphate. The weight of the sample had decreased by 0.126 gm.

A sample of Concentrate No. 2 which had not been reacted with aqueous sulphur dioxide but otherwise was treated in a similar manner did not decrease in weight. This indicates the effect of the aqueous sulphur dioxide in producing sulphur which can be removed by the steam and nitrogen.

Another sample of the above reaction product was treated by the same procedure except that only nitrogen was passed over the sample. The sample, which weighed 1.90 gm before treatment, decreased in weight by 0.127 gm, illustrating sulphur removal by nitrogen.

Using a soxhlet extraction technique 1.83 gm of a sample of the above reaction product was extracted with carbon disulphide. The weight of the sample decreased by 0.106 gm, illustrating sulphur removal by carbon disulphide.

We claim:

1. A process for the treatment of lead sulphide to produce at least one of lead sulphite and lead sulphate comprising the step of contacting lead sulphide with an aqueous solution of sulphur dioxide at a temperature of at least 20° C substantially in the absence of oxygen.

2. The process of claim 1 in which the temperature is in the range of about 20°–90° C.

3. The process of claim 1 in which the temperature is at least about 90° C.

4. The process of claim 1 in which sulphur is separated from the lead sulphide so treated.

5. The process of claim 1 in which at least 50% of the lead sulphide treated is converted to at least one of lead sulphite and lead sulphate.

6. The process of claim 1 in which the lead sulphide is treated such that a mixture comprising about one mole of lead sulphide per one mole of lead sulphate and per two moles of lead sulphite is obtained.

7. The process of claim 1 in which the lead sulphide is treated with a saturated aqueous solution of sulphur dioxide.

8. A process for the recovery of lead from lead sulphide comprising the steps of a. contacting lead sulphide with an aqueous solution of sulphur dioxide at a temperature of at least 20° C substantially in the absence of oxygen, b. separating at least one of lead sulphate and lead sulphite in the resulting mixture from sulphur therein, and c. heating a mixture of lead sulphide and at least one of said lead sulphate and lead sulphite to a temperature in the range 700° to 1200° C substantially in the absence of oxygen, the sulphur dioxide formed on heating the mixture being removed therefrom.

9. The process of claim 8 in which the temperature in step (c) is in the range 750° to 900° C.

10. The process of claim 9 in which the temperature in step (a) is in the range of about 20° to 90° C.

11. The process of claim 9 in which the temperature in step (a) is at least 90° C.

12. The process of claim 8 in which at least 50% of the lead sulphide processed in step (a) is converted to at least one of lead sulphite and lead sulphate.

13. The process of claim 8 in which part of the lead sulphide processed is reacted in step (a), and the remainder of the lead sulphide processed is used in step (c).

14. The process of claim 8 in which in step (a) the lead sulphide is treated such that a mixture comprising about one mole of lead sulphide is obtained per one mole of lead sulphate and per two moles of lead sulphite.

15. The process of claim 8 in which at least part of the sulphur dioxide obtained in step (c) is recycled to step (a).

16. The process of claim 8 in which the lead sulphide of either step (a) or step (c) or both contains zinc sulphide.

17. The process of claim 8 including the step of separating the lead formed in step (c).

18. The process of claim 8 in which in step (a) the lead sulphide is treated such that a mixture comprising about one mole of lead sulphide is obtained per one mole of lead sulphate and per two moles of lead sulphite, at least 50% of the lead sulphide treated in step (a) is converted to at least one of lead sulphite and lead sulphate, part of the lead sulphide processed is reacted in step (a), and the remainder of the lead sulphide processed is used in step (c), in step (c) the temperature is in the range 750° to 900° C, at least part of the sulphur dioxide obtained in step (c) is recycled to step (a), and comprising the additional step (d) separating the lead formed in step (c).

* * * * *